United States Patent [19]

Sommer, Jr.

[11] 4,086,053

[45] Apr. 25, 1978

[54] CLOTHES DRYER GAS HEATER ASSEMBLY

[75] Inventor: Edward G. Sommer, Jr., Louisville, Ky.

[73] Assignee: General Electric Company, Louisville, Ky.

[21] Appl. No.: 721,760

[22] Filed: Sep. 9, 1976

[51] Int. Cl.[2] ..... F24H 1/00; F26B 11/04

[52] U.S. Cl. ..... 432/222; 34/133; 432/120

[58] Field of Search ..... 432/44, 36, 222, 120; 34/133, 46

[56] References Cited

U.S. PATENT DOCUMENTS

| | | | |
|---|---|---|---|
| 3,132,853 | 5/1964 | Fleer et al. | 432/44 |
| 3,536,308 | 10/1970 | White | 432/44 |
| 3,669,428 | 6/1972 | Jones | 432/222 |
| 3,932,119 | 1/1976 | Alms | 432/222 |
| 3,995,988 | 12/1976 | Freze | 34/133 |

*Primary Examiner*—John J. Camby
*Attorney, Agent, or Firm*—Frederick P. Weidner; Francis H. Boos

[57] ABSTRACT

An automatic clothes dryer having a gas heater assembly for heating the air includes a gas control valve and a gas nozzle in gas flow communication with the valve. The gas nozzle has an exit orifice having spaced therefrom a plate member such that gas will impinge the plate member. A combustion chamber having a truncated cone shaped upper portion and with an opening at the top and bottom thereof surrounds and is spaced outwardly of both the plate member and the nozzle. The bottom opening of the combustion chamber is arranged to allow air into the combustion chamber for mixing with the gas exiting the nozzle orifice. A hood member is spaced outwardly and below the opening at the top of the combustion chamber to allow ambient air into the hood member for mixing with the heated air. There is also provided an igniter for igniting the gas and air mixture.

10 Claims, 3 Drawing Figures

CLOTHES DRYER GAS HEATER ASSEMBLY

BACKGROUND OF THE INVENTION

1. Field of the Invention

This invention relates to an improved clothes dryer and more particularly, to an improved gas heater assembly for use in clothes dryers.

2. Description of the Prior Art

Many clothes dryers utilize gas or fluid fueled heaters for heating the air flowing through the clothes dryer. Such a gas clothes dryer is shown for instance in U.S. Pat. No. 3,558,110 assigned to the same assignee as the present invention. These prior art gas clothes dryers have the air provided to the drum heated by a gas flame that issues from a burner. The burner receives a regulated supply of gas from a control valve assembly and primary air for mixing with the gas is drawn into the burner through an inlet opening which is controlled by a shutter. The primary air and gas mixture in the burner is ignited and the gas flame is then spread out by a spreader formed at the outlet end of the burner. This spreader is located just within the combustion chamber so that secondary air is drawn in through the end of the chamber and is also heated to a high temperature. The outlet end of the combustion chamber communicates with a duct which provides a number of air openings in order to reduce the temperature of the heated air to an appropriate extent before it is introduced into the drum.

One of the difficulties with the above described prior art gas burners is that considerable space is taken up within the clothes dryer to first get the correct gas and air mixture burned and then reduce the temperature adequately so that upon entry into the drum it does not detrimentally affect the clothes being dried.

It is desirable to minimize the space necessary to obtain optimum performance of a gas heater assembly and to have such gas heater assembly easy to manufacture and assemble. Moreover, it is desirable to reduce the number of component elements thus making the gas heater assembly less expensive yet efficient in its operation.

By this invention the above-described desirable characteristics of a gas heater assembly for a clothes dryer may be achieved.

SUMMARY OF THE INVENTION

There is provided an automatic clothes dryer having an improved gas heater assembly for heating the air. Within the clothes dryer is a gas control valve which is in gas flow communication with a gas nozzle having an exit orifice. Located in spaced relationship with the nozzle orifice is a plate member upon which the gas will impinge. A combustion chamber having a truncated cone-shaped upper portion with an opening at the top and bottom thereof surrounds and is spaced outwardly of both the plate member and nozzle such that the bottom opening allows air into the combustion chamber for mixing with the gas exiting the nozzle orifice. There is also provided a means, such as an electrical resistance igniter, for igniting the gas and air mixture after it impinges the plate member. A hood member over and spaced outwardly of the opening at the top of the combustion chamber is arranged to allow ambient air into the hood member for mixing with the heated air to rapidly reduce the temperature of the air exiting the combustion chamber.

DESCRIPTION OF THE PREFERRED EMBODIMENT

Figure 1:
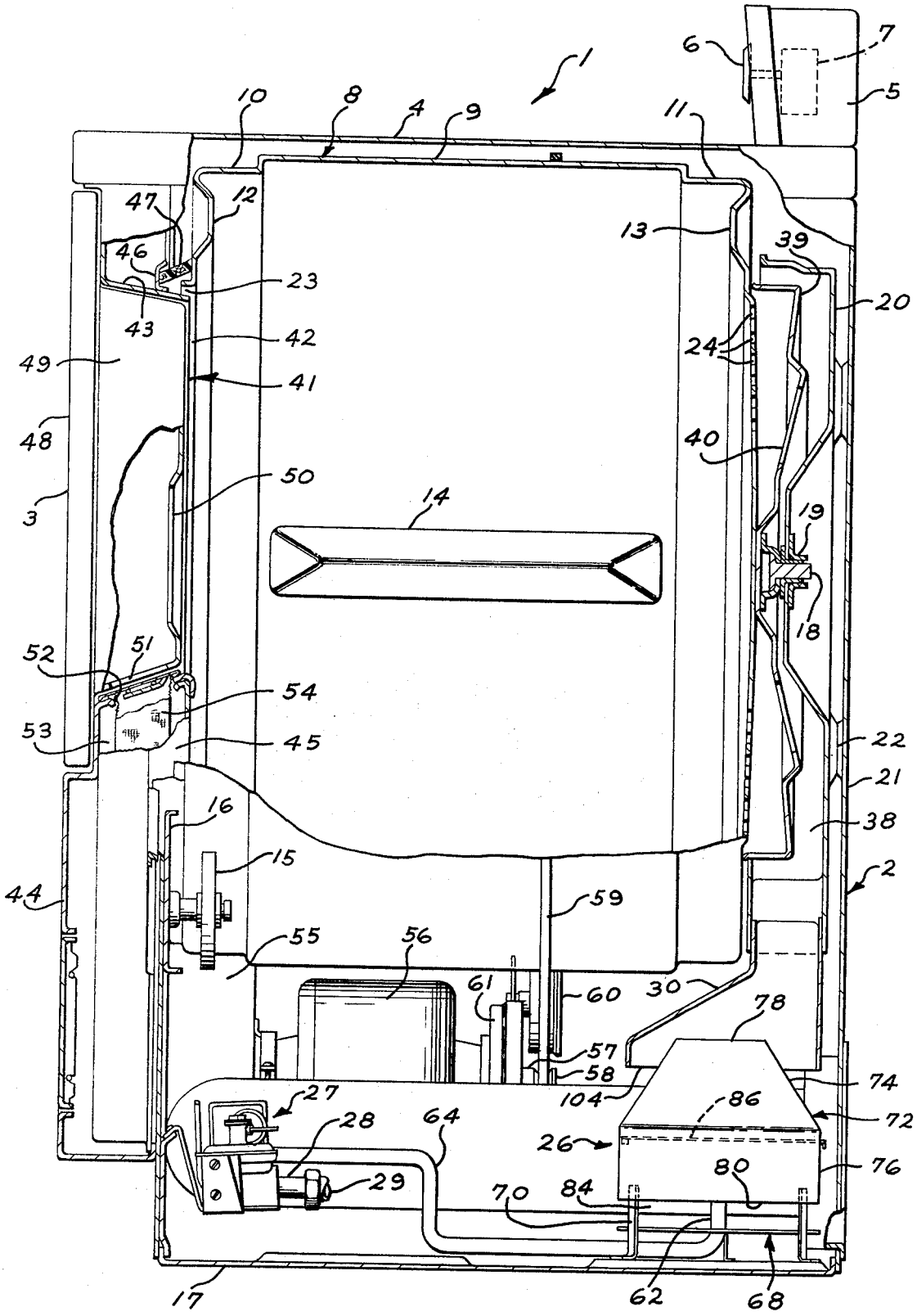
FIG. 1 is a side elevational view of a clothes dryer incorporating the improved gas heater assembly of the present invention, the view being partly broken away and partly in section to illustrate details.

Referring now to FIG. 1, the machine illustrated is a domestic fabric or clothes dryer generally indicated by the numeral 1. Dryer 1 includes a cabinet 2 having a front door 3 to provide access to the interior of the cabinet for loading and unloading clothes. Provided on the top 4 of cabinet 2 is a control panel 5, which may, in a conventional way, include a suitable manual control 6 connected to a control assembly 7 mounted in the panel 5. By manual setting of control 6, the machine may be caused to start and automatically proceed through a cycle of operation.

Within cabinet 2, there is provided a clothes tumbling chamber, or drum 8. Drum 8 is substantially cylindrical in shape, having a center cylindrical wall portion 9, and outer cylindrical wall portions 10 and 11 located respectfully adjacent an annular front wall 12 and a circular rear wall 13 of the drum. Wall portions 9, 10 and 11 are imperforate over their entire area so that the outer shell of the drum is imperforate. On the interior surface of wall portion 9 there are a plurality of clothes tumbling ribs 14 so that clothes are lifted up when the drum rotates, and then tumble back down to the bottom of the drum.

The front of the drum 8 may be rotatably supported within outer casing 2 by suitable idler wheels, one of which is indicated by the numeral 15. These wheels are rotatably secured to the top of a member 16 which extends up from the base 17 of the machine. The wheels 15 are disposed beneath the drum, in contact with portion 10, so as to support the portion 10 on each side to provide a stable support.

The rear end of drum 8 receives its support by means of a stub shaft 18 extending from the center of wall 13. Shaft 18 is secured within a bearing 19 formed in a baffle-like structure 20 which, in turn, is rigidly secured to the back wall 21 of the cabinet 2 by any suitable means such as welding at a number of points 22. With the arrangement shown, the drum may rotate on a horizontal axis, with rollers 15 providing the front support and stub shaft 18 within bearing 19 providing the rear support.

In order to provide for the flow of a stream of drying air through the clothes drum, the drum is provided with a central aperture 23 defined by the front wall 12 and with a plurality of perforations 24 in the rear wall 13. Perforations 24 in the present case are formed to extend around the rear wall in an annulus.

The air provided to the drum is heated by a gas flame within the heater assembly 26, the detailed structure and arrangement of the heater assembly will be discussed later. The heater assembly 26 receives a regulated supply of gas from a control valve assembly 27, the gas being supplied to the assembly 27 through a supply pipe or conduit 29 connected to the assembly inlet 28. Heated air from the heater assembly 26, which also includes a hood member 30, enters a generally circular heat diffuser chamber 38 formed between the member 20 and a baffle 39 which is rigidly secured to the outer surface of wall 13. Baffle 39 has openings 40 formed therein so that the heated air may flow from the chamber 38 through the openings 40 and perforations 24 into the drum 8.

The front opening 23 of the drum is substantially closed by means of a stationary bulkhead generally indicated by the numeral 41. Bulkhead 41 is made up of a number of adjacent members including the inner surface 42 of the access door 3, a stationary frame 43 formed as a flange of front wall 44 of the cabinet, the inner surface member 45 of an exhaust duct formed by the cooperation of member 45 and the front wall 44 of the cabinet, and an annular flange 46 mounted on the frame 43. It will be noted that a suitable clearance is provided between the inner edge of the aperture 23 and the edge of bulkhead 41 so that there is no rubbing between the drum and the bulkhead during rotation of the drum. In order to prevent a substantial air leakage through the aperture 23, a suitable ring seal 47 is secured to the flange 46 in sealing relationship with the exterior surface of the drum wall 12.

Central aperture 23, in addition to serving as part of the air flow passage to the drum, also serves as a means whereby clothes may be loaded into and unloaded from the drum. Door 3, whose inner surface forms part of the bulkhead closing the opening, is mounted on cabinet 2 so that when the door is open clothes may be inserted into and removed from the drum through the door frame 43. It will be noted that the door includes an outer, flat imperforate section 48 and an inwardly extending hollow section 49 mounted on the flat outer section. Hollow section 49 extends into the door frame 43 when the door is closed, and the door surface 42, which comprises part of the combination bulkhead 41, is actually the inner wall of the hollow section.

The air outlet from the drum is provided by a perforated opening 50 formed in the inner wall 42 of hollow door section 49. The bottom wall section of door 3 and the adjacent wall of door frame 43 are provided with aligned openings 51 and 52, opening 52 providing an entrance to duct 53 formed by the cooperation of member 45 with front wall 44. A lint trap 54 is positioned in the exhaust duct 53 and opening 52 and is supported by the door frame 43. Duct 53 leads downwardly and communicates with a housing 55. Housing 55 contains a blower (not shown) which is directly driven by motor 56. The blower draws heated air through the duct 54 and then exhausts it from the cabinet 2 through an appropriate duct (not shown).

In addition to driving the blower, motor 56 constitutes the means for effecting rotation of drum 8. In order to effect this rotation, motor 56 is provided with a shaft 57 having a small pulley 58 formed at one end thereof. A belt 59 extends around the pulley 58 and also entirely around the wall section 9 of drum 8. The relative circumferences of the pulley 58 and the wall section 9 cause the drum to be driven by the motor at a speed suitable to effect tumbling of clothes therein. In order to effect proper tensioning of the belt 59, a suitable idler assembly 60 is secured to the same support 61 which supports one end of the motor. Thus, the air is pulled through the drum and, at the same time, the fabrics in the drum are tumbled. The air is heated by the flame that is emitted by the heater assembly 26. The heated air passing through the drum causes vaporization of moisture from the clothes. The vapor is carried off with the air as it passes out of the machine.

Figure 2:
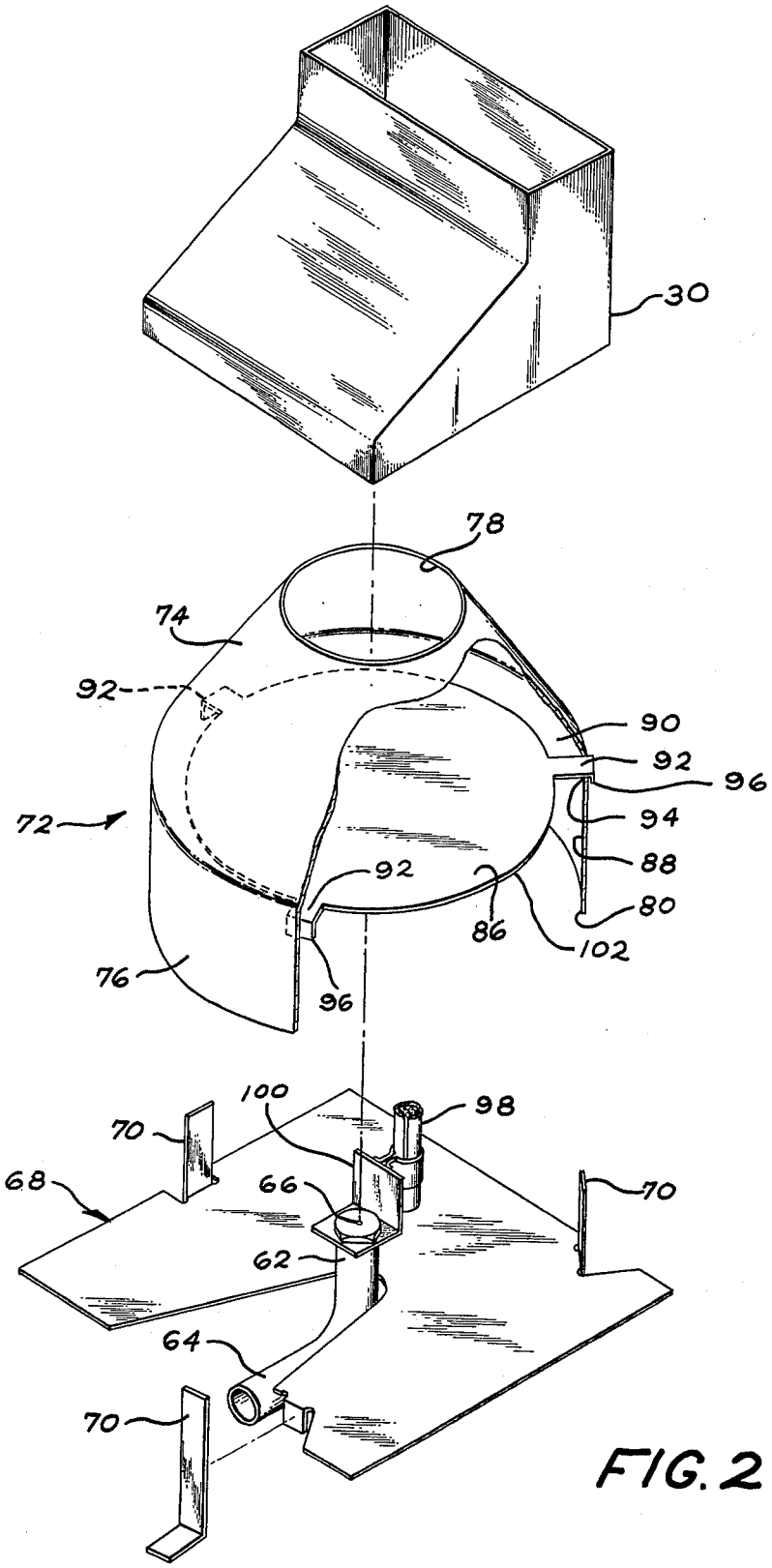
FIG. 2 is an exploded perspective view showing the gas heater assembly of the present invention.
Figure 3:
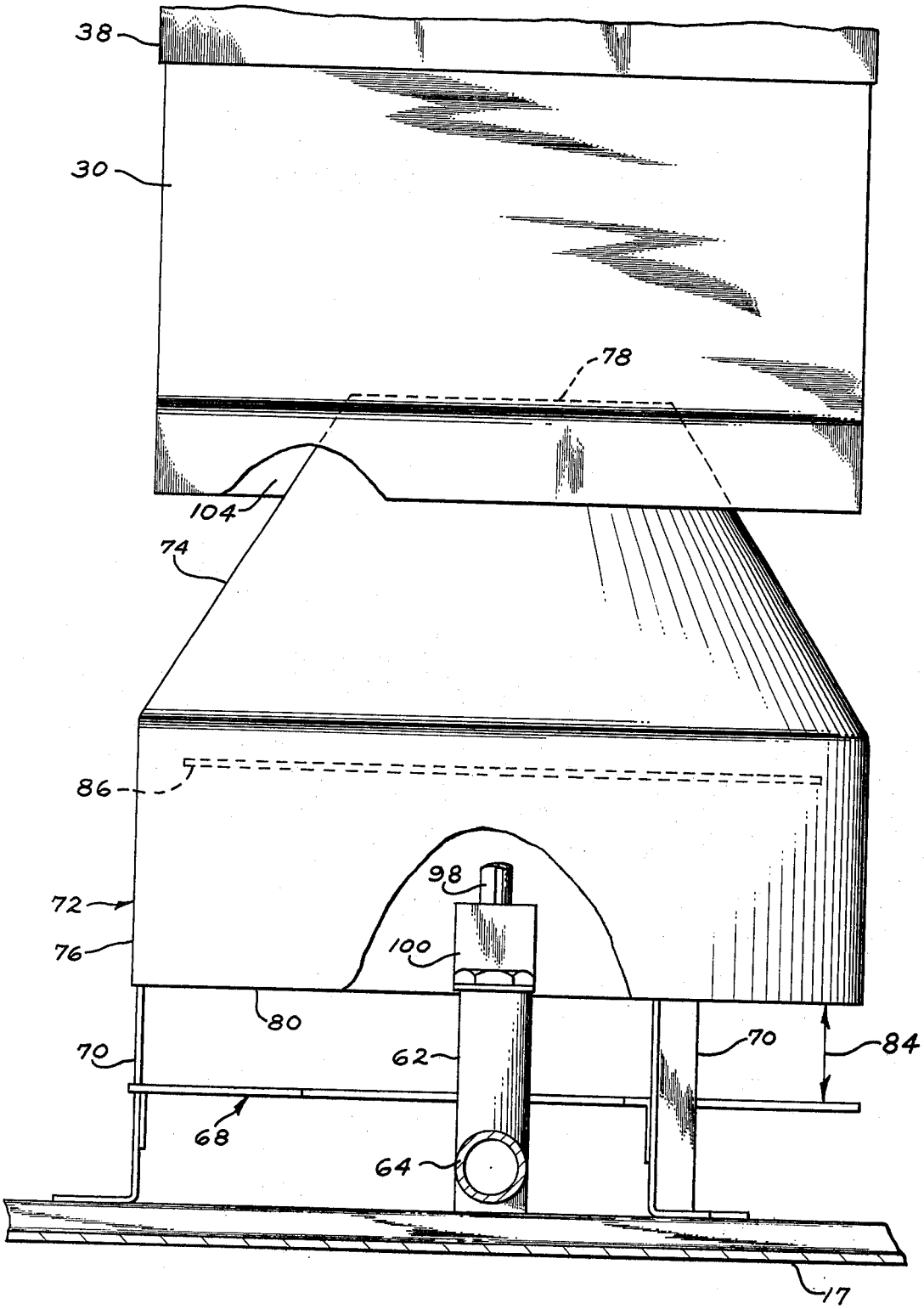
FIG. 3 is a side elevational view of the gas heater assembly of the present invention, the view being partly broken away.

With reference to FIGS. 2 and 3 in particular, the structure and arrangement of components of the heater assembly 26 will be discussed in detail. Connecting the control valve assembly 27 with gas nozzle 62 is a gas conduit 64 to provide gas flow communication therebetween. The gas nozzle 62 has at its upper end which is upturned and directed vertically upward, an orifice 66. The nozzle 62 projects through a radiation shield 68 which is, as shown in FIGS. 1 and 3, secured to the base 17 of the dryer and is spaced from the base to provide means for preventing excessive heat reaching the base 17. The radiation shield 68 is made of flat sheet metal and is secured to the base 17 by any suitable means such as support legs 70. Above the radiation shield and spaced therefrom is a combustion chamber 72 having a truncated cone-shaped upper portion 74 and the lower portion 76 which is cylindrically shaped. The combustion chamber has an opening 78 at the top of the truncated cone portion 74 and the bottom of the combustion chamber has an opening 80. The combustion chamber 72 is supported above the radiation shield 68 by an extension of support legs 70 arranged such that the combustion chamber is centered over the orifice 66 of the gas nozzle 62 and surrounds and is spaced outwardly of the nozzle with the cylindrical lower portion 76 extending downwardly over the orifice 66 as seen in FIG. 3. It will be noted that with this arrangement there is an opening 84 between the radiation shield 68 and the combustion chamber 72 to allow air into the combustion chamber for mixing with the gas to achieve optimum combustion of the gas and air mixture when it is ignited.

Secured within the combustion chamber 72 is a plate member 86. This plate member is spaced above the nozzle orifice 66 such that gas will impinge upon the center of the plate member 86. Plate member 86 is spaced inwardly from the side wall 88 of the cylindrical lower portion 76 of the combustion chamber to provide a space 90 between the periphery of the plate member 86 and the side wall 88. The plate member 86 is retained in its proper position within the combustion chamber by three support members 92 that extend radially outward of the periphery of the plate member 86 and pass through slots 94 in the side wall 88 of the cylindrical lower portion 76 of the combustion chamber. It is advantageous to not firmly affix the support members 92 to the combustion chamber but rather have them loosely connected to allow for expansion and contraction by the plate member 86 thereby minimizing distortion of the plate member. Support members 92 may have a downwardly depending flange 96 to help retain the plate member 86 in its proper position within the combustion chamber.

Located between the orifice 66 of gas nozzle 62 and plate member 86 and within the periphery of the plate member 86 is a means to ignite the gas and air mixture after it impinges the plate member 86. In the preferred embodiment this igniting means is an electrical resistance igniter 98.

Such electrical resistance igniters are widely used in clothes dryers and are well known in the art. Electric resistance igniter 98 may be secured in its proper position by means of a bracket 100 secured to the upper end of gas nozzle 62.

The hood member 30 is positioned over the top opening 78 of the combustion chamber 72 such that the hood member is spaced outwardly and below the top opening 78 to allow ambient air into the hood member 30 through opening 104 between the hood and the combustion chamber. The hood member 30 may be of any shape to accomplish its function and that shape will depend somewhat on the space available within the clothes dryer.

The operation of the gas heater assembly is as follows: Gas from control valve assembly 27 passes through gas conduit 64 and nozzle 62 and is expelled through orifice 66. The expelled gas mixes with primary air entering the combustion chamber 72 through opening 84. The mixture of gas and air impinges the lower surface of plate member 86 and flows radially outward along the lower surface of the plate member. The electrical resistance igniter ignites the gas and air mixture between the point of impingement and the periphery 102 of plate member 86. The gas and air mixture burns around the outer periphery of the plate member as the plate member acts both as a flame spreader and to retain the flame in the area of the plate member. During combustion of the gas and air mixture the temperature can reach 2,000° F. The heated air as a result of the combustion of the gas and air mixture passes upwardly around the plate member 86 through space 90 between the periphery 102 of the plate member 86 and side wall 88 of the combustion chamber 72 and into the upper truncated cone-shaped portion 94 whereupon it passes out through opening 78 at the top thereof. At this point the air temperature would be too high for introduction into the clothes dryer drum and could detrimentally affect the clothes being dried. To reduce the temperature, ambient air is drawn into the hood member 30 through inlet opening 104 between the hood member 30 and the truncated cone-shaped upper portion 74 of the combustion chamber 72. This ambient air mixes with the heated air exiting the combustion chamber 72 via opening 78 and will reduce the temperature of the air to about 600° F. The heated air then flows upwardly into the heat diffuser chamber 38 and then enters the drum containing the clothes to be dried as described heretofore.

The gas heater assembly components are made of sheet metal and in particular the plate member 86 is made of stainless steel sheet and the combustion chamber 72 is made of steel coated on both sides with aluminum for corrosion resistance. The hood member 30 and radiation shield 68 may be made of suitable sheet metal also.

By my invention I have provided a gas heater assembly that is simple in construction, easy to manufacture and assemble, yet is efficient in its operation. Moreover, the gas heater assembly minimizes the amount of space necessary to first heat the air and then reduce the temperature to a level suitable for introduction into the clothes dryer drum.

The foregoing is a description of the preferred embodiment of the invention. In accordance with the Patent Statutes, changes may be made in the disclosed apparatus and the manner in which it is assembled without actually departing from the true spirit and scope of this invention, as defined in the appended claims.

What is claimed is:

1. In a clothes dryer having a gas heater assembly for heating the air, the improvement comprising:

a. a gas control valve, b. a gas nozzle in gas flow communication with the valve, said nozzle having an exit orifice, c. a plate member spaced from the nozzle orifice, such that gas will impinge the plate member, d. a combustion chamber having a truncated cone-shaped upper portion with downwardly diverging side walls, said chamber having an opening at the top and bottom thereof, said chamber surrounding and spaced outwardly of both the plate member and nozzle, said bottom opening arranged to allow air into the combustion chamber below the nozzle orifice for mixing with the gas exiting the nozzle orifice, e. means to ignite the gas and air mixture after it impinges the plate member, and f. a hood member over and spaced outwardly of the opening at the top of the combustion chamber to allow ambient air into the hood member for mixing with the heated air.

2. In the clothes dryer of claim 1 wherein the gas exit nozzle is directed vertically upward.

3. In the clothes dryer of claim 1 wherein a radiation shield member is located below and spaced from the bottom opening of the combustion chamber.

4. In the clothes dryer of claim 1 wherein the means to ignite the gas is an electric resistance igniter located between the nozzle orifice and the plate member, said igniter being within the periphery of the plate member.

5. In the clothes dryer of claim 1 wherein the hood member extends below the opening at the top of the combustion chamber.

6. In the clothes dryer of claim 1 wherein the plate member is loosely supported to accommodate expansion and contraction of the plate member.

7. In the clothes dryer of claim 1 wherein the plate member is circular in shape.

8. In the clothes dryer of claim 1 wherein the plate member is circular in shape and supported on the combustion chamber by three equally spaced support arms.

9. In the clothes dryer of claim 1 wherein the lower portion of the combustion chamber is cylindrical in shape.

10. In a clothes dryer having a gas heater assembly for heating the air, the improvement comprising:

a. a gas control valve, b. a gas nozzle in gas flow communication with the valve, said nozzle having an exit orifice directed vertically upward, c. a plate member loosely supported to accommodate expansion and contraction and spaced from the nozzle orifice, such that gas will impinge the plate member, d. a combustion chamber having a truncated cone-shaped upper portion with downwardly diverging side walls and a cylindrical lower portion, said chamber having an opening at the top and bottom thereof, said lower portion of the chamber surrounding and spaced outwardly of both the plate member and nozzle, said bottom opening arranged to allow air into the combustion chamber below the nozzle orifice for mixing with the gas exiting the nozzle orifice, e. means to ignite the gas and air mixture after it impinges the plate member, and f. a hood member over and spaced outwardly of and below the opening at the top of the combustion chamber to allow ambient air into the hood member for mixing with the heated air.

* * * * *